US010674777B2

(12) United States Patent
Fisher

(10) Patent No.: US 10,674,777 B2
(45) Date of Patent: Jun. 9, 2020

(54) APPAREL POCKET SYSTEM

(71) Applicant: NIKE, Inc., Beaverton, OR (US)

(72) Inventor: Kimberly R. Fisher, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 180 days.

(21) Appl. No.: 15/886,120

(22) Filed: Feb. 1, 2018

(65) Prior Publication Data

US 2018/0228232 A1 Aug. 16, 2018

Related U.S. Application Data

(60) Provisional application No. 62/457,388, filed on Feb. 10, 2017.

(51) Int. Cl.

| | |
|---|---|
| ***A41D 27/00*** | (2006.01) |
| ***A41D 27/20*** | (2006.01) |
| ***A41D 27/02*** | (2006.01) |
| ***A41F 9/00*** | (2006.01) |
| *A41D 7/00* | (2006.01) |
| *A41C 3/00* | (2006.01) |

(52) U.S. Cl.

CPC ..... *A41D 27/20* (2013.01); *A41D 27/02* (2013.01); *A41D 27/204* (2013.01); *A41F 9/00* (2013.01); *A41C 3/0035* (2013.01); *A41D 7/005* (2013.01)

(58) Field of Classification Search

CPC ..... A41D 27/20; A41D 27/204; A41D 27/02; A41F 9/00; A41C 3/0035

USPC ..... 2/247

See application file for complete search history.

(56) References Cited

U.S. PATENT DOCUMENTS 2,359,012 A 9/1944 Max
2,544,840 A * 3/1951 Kowatsch ..... A41D 7/005 2/67

(Continued)

FOREIGN PATENT DOCUMENTS

EP 2815662 A1 12/2014
JP 2001011718 A 1/2001

OTHER PUBLICATIONS

Men's R-Gear Out of Sight Camo 2-in-1 7" Short, Road Runner Sports, roadrunnersports.com, Item #06358, accessed: Jan. 2017, 2 pages. http://www.roadrunnersports.com/rrs/products/06358/mens-rgear-out-of-sight-sightcamo-2in1-7-short/?cc=403&s=L.

(Continued)

*Primary Examiner* — Khaled Annis

(74) *Attorney, Agent, or Firm* — Shook, Hardy and Bacon LLP

(57) ABSTRACT

Aspects herein provide for a pocket structure for an apparel item. The apparel item comprises an outer panel of material, an inner panel of material, a pocket panel, and a double-layer trim piece such as a waistband. A top edge of the outer panel is affixed to an outer layer of the waistband, and a top edge of the inner panel is affixed to an inner layer of the waistband. The pocket panel is positioned between the inner panel and the outer panel, and a top edge of the pocket panel is affixed to the outer layer of the waistband, and a bottom edge of the pocket panel is affixed to the inner panel of material. A pocket space is defined between the pocket panel and the inner panel of material. An opening to the space is formed through the outer layer of the waistband.

9 Claims, 4 Drawing Sheets

(56) References Cited

U.S. PATENT DOCUMENTS

| | | | | |
|---|---|---|---|---|
| 4,845,784 | A | 7/1989 | Shirinian | |
| 5,052,058 | A | 10/1991 | Mueller | |
| 5,598,586 | A | 2/1997 | Munjone | |
| 5,649,328 | A * | 7/1997 | Martin | A41D 1/08 2/238 |
| 5,669,078 | A * | 9/1997 | Scremin | A41D 27/20 2/22 |
| 5,870,777 | A | 2/1999 | Hans | |
| 6,148,443 | A | 11/2000 | Maastricht | |
| 7,003,810 | B2 | 2/2006 | Goldkind | |
| 9,021,615 | B2 | 5/2015 | Cockram | |
| 9,060,550 | B2 | 6/2015 | Conrad | |
| 9,254,010 | B2 | 2/2016 | Hedrick | |
| 9,271,532 | B2 | 3/2016 | Cole | |
| 9,532,618 | B2 | 1/2017 | Garabedian | |
| 2005/0091730 | A1 * | 5/2005 | Stanko | A41D 13/0012 2/250 |
| 2007/0000030 | A1 * | 1/2007 | Toomey | A41D 1/04 2/247 |
| 2007/0067889 | A1 * | 3/2007 | Spiewak | A41D 1/002 2/69 |
| 2008/0263742 | A1 * | 10/2008 | Vaughn | A41D 1/08 2/69 |
| 2010/0281595 | A1 * | 11/2010 | Gernes | A41B 9/001 2/69 |
| 2011/0094003 | A1 * | 4/2011 | Spiewak | A41B 1/08 2/69 |
| 2013/0014311 | A1 | 1/2013 | Chapuis | |
| 2013/0091619 | A1 | 4/2013 | Hacker et al. | |
| 2013/0298300 | A1 * | 11/2013 | Schaeper | A41D 11/00 2/67 |
| 2015/0040281 | A1 | 2/2015 | Gbadamosi | |
| 2015/0074871 | A1 | 3/2015 | Emich et al. | |
| 2015/0257459 | A1 | 9/2015 | Cockram | |
| 2016/0331053 | A1 | 11/2016 | Gordon et al. | |
| 2017/0172239 | A1 * | 6/2017 | Staub | A41B 1/08 |
| 2017/0295870 | A1 * | 10/2017 | Harris | A41C 3/0057 |
| 2017/0354192 | A1 * | 12/2017 | Albano | A41D 1/089 |

OTHER PUBLICATIONS

Lucy Brand Run Shorts, Sports Direct, sportsdirect.com, accessed: Jan. 2017, 5 pages. https://poshmark.com/listing/Lucy-Brand-Run-Shorts-58370eed2ba50a656e032bf7.

Skins DNAmic 2 in 1 Running Shorts Mens, Sports Direct, sportsdirect.com, accessed: Jan. 2017, 3 pages. http://www.sportsdirect.com/skins-dnamic-2-in-1-shorts-mens-453858.

International Search Report and Written Opinion dated May 7, 2018 in International Patent Application No. PCT/US2018/017543, 14 pages.

International Preliminary Report on Patentability dated Aug. 22, 2019 in International Patent Application No. PCT/US2018/017543, 8 pages.

* cited by examiner

APPAREL POCKET SYSTEM

CROSS-REFERENCE TO RELATED APPLICATIONS

This application, having U.S. application Ser. No. 15/886,120, filed Feb. 1, 2018, and entitled "Apparel Pocket System," claims the benefit of priority of U.S. Prov. application No. 62/457,388, entitled "Apparel Pocket System," and filed Feb. 10, 2017. The entirety of the aforementioned application is incorporated by reference herein.

TECHNICAL FIELD

Aspects herein provide for a pocket system for an apparel item.

BACKGROUND

In general pocket systems in apparel items are designed to stow objects. However, it can be challenging to configure a low-profile pocket system for athletic apparel items, where the pocket system is useable for securely stowing objects while minimizing distractions due to movement of the stowed objects.

BRIEF DESCRIPTION OF THE DRAWINGS

Examples of the present invention are described in detail below with reference to the attached drawing figures, wherein.

DETAILED DESCRIPTION

Figure 1:
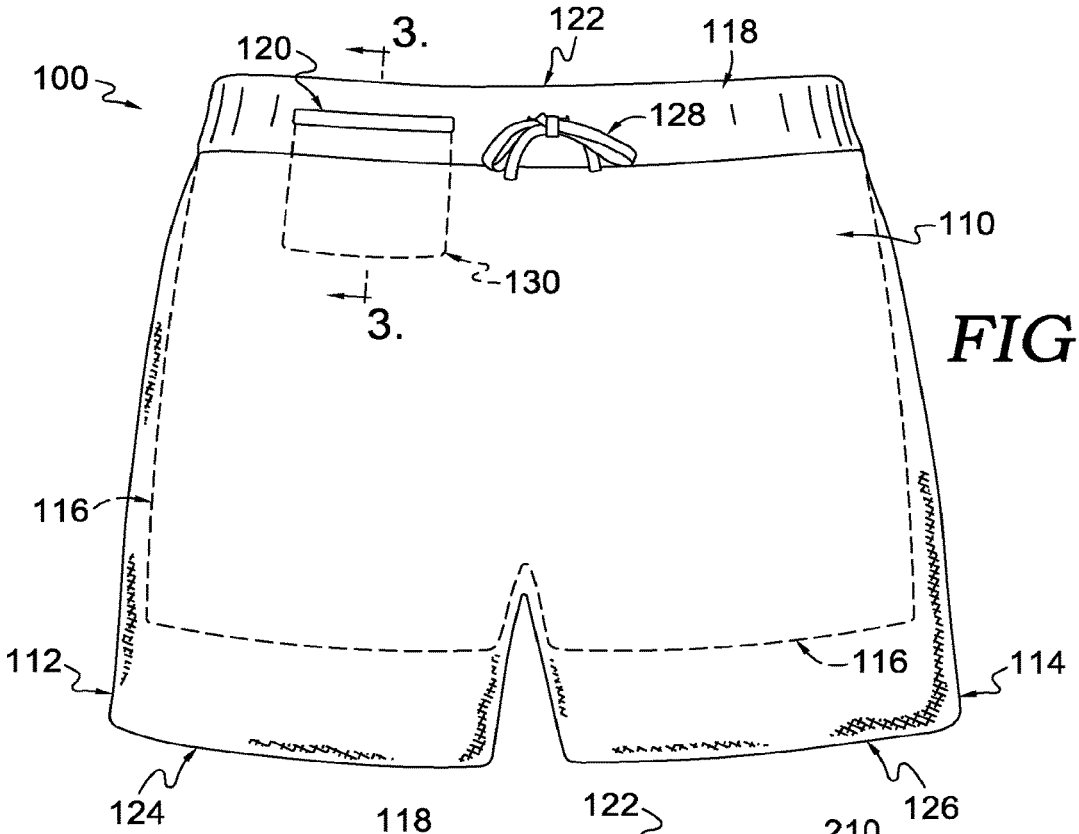
FIG. 1 illustrates a front view of an apparel item having an exemplary pocket system in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a pocket system for an apparel item, where the pocket system is configured to be low profile, to securely stow objects, and to minimize movement of the stowed objects so as to reduce distractions and improve wearer comfort. In exemplary aspects, the apparel item comprises an outer panel of material, an inner panel of material, a pocket panel, and a double-layer trim piece such as a waistband. A top edge of the outer panel is affixed to an outer layer of the double-layer trim piece, and a top edge of the inner panel is affixed to an inner layer of the double-layer trim piece. The pocket panel is positioned between the inner panel of material and the outer panel of material, and a top edge of the pocket panel is affixed to the outer layer of the double-layer trim piece and a bottom edge of the pocket panel is affixed to the inner panel of material. A pocket space is defined between at least the pocket panel and the inner panel of material. A slit-type opening to the space is formed through the outer layer of the double-layer trim piece. In aspects, the perimeter edges of the pocket panel are further affixed to the inner panel of material.

By configuring the pocket system as described, the pocket is generally "hidden" from view. That is, by configuring the opening to the pocket as a slit-type opening on the waistband, and by positioning the pocket panel between the inner and outer panels of the apparel item, the pocket system assumes a low profile. This may be useful in athletic apparel, especially form-fitting athletic apparel where a sleeker aesthetic may be desired. This configuration also helps to securely stow objects as compared to, for instance, pocket systems located on the outer-facing surface of the apparel item. Further, by affixing the perimeter edges of the pocket panel to the inner panel of the apparel item, the pocket is generally prevented from shifting or moving during wearer movement, especially when the pocket is used to stow objects. This, in turn, may help minimize wearer distraction and improve wearer comfort. In addition, the use of a single pocket panel to form the pocket system helps to reduce the weight of the apparel item as compared to pocket systems that may utilize multiple layers of material to construct the pocket. This may be advantageous in performance athletic wear where low-weight apparel is desired.

Accordingly, in one aspect, an apparel item for a lower torso of a wearer is provided. The apparel item comprises an outer panel of material, and an inner panel of material, where the outer panel of material and the inner panel of material form at least a torso portion of the apparel item. The apparel item further comprises a waistband having at least a first layer and a second layer where at least one opening is formed in the first layer of the waistband. A top edge of the outer panel of material is affixed to the first layer of the waistband, and a top edge of the inner panel of material is affixed to the second layer of the waistband. The apparel item further comprises at least one pocket panel positioned between the outer panel of material and the inner panel of material, where the pocket panel comprises at least a top edge, a bottom edge, and opposing side edges. The top edge of the pocket panel is affixed to the first layer of the waistband, and the bottom edge of the pocket panel is affixed to the inner panel of material so as to define a space between the pocket panel and at least the inner panel of material. The opening in the first layer of the waistband is in communication with the space between the pocket panel and the inner panel of material.

In another aspect, an apparel item for a lower torso of a wearer is provided. The apparel item comprises an outer panel of material having at least a top edge, where an opening is formed in the outer panel of material adjacent the top edge. The apparel item further comprises an inner panel of material having at least a top edge, where the outer panel of material and the inner panel of material define at least a torso portion of the apparel item. The apparel item further comprises a pocket panel positioned between the outer panel of material and the inner panel of material. The pocket panel has at least a top edge and a bottom edge, where the top edge of the pocket panel is affixed to the outer panel of material at a location inferior to the opening, and the bottom edge of the pocket panel is affixed to the inner panel of material so as to define a space between the pocket panel and the inner panel of material. The opening in the outer panel of material is in communication with the space between the pocket panel and the inner panel of material.

In yet another aspect, an apparel item is provided comprising a first panel of material, and a second panel of material positioned adjacent to the first panel of material so that a first surface of the second panel of material is positioned adjacent to a first surface of the first panel of material, where the first panel of material and the second panel of material form at least in part the apparel item. The apparel item further comprises a trim piece positioned between the first panel of material and the second panel of material. The trim piece has an outer-facing layer and an inner-facing layer, and an opening is formed in the outer-facing layer of the trim piece. A first edge of the first panel of material is affixed to the outer-facing layer of the trim piece, and a first edge of the second panel of material is affixed to the inner-facing layer of the trim piece. A pocket panel is positioned between the first panel of material and the second panel of material, where the pocket panel has at least a first edge and a second edge opposite the first edge. The first edge of the pocket panel is affixed to the outer-facing layer of the trim piece adjacent to the opening, and the second edge of the pocket panel is affixed to the second panel of material so as to define a pocket space between the pocket panel and the second panel of material. The opening in the outer-facing layer of the trim piece is in communication with the pocket space.

Positional terms as used herein such as "superior," "top," "bottom," "inferior," "anterior," "posterior," and the like are to be given their common meaning with respect to the apparel item being worn as intended by a hypothetical wearer standing in an upright position. The term "apparel item" as used herein, may comprise apparel items such as shirts, pants, shorts, jackets, coats, and the like. It may further comprise items such as socks, hats, shoes, and other types of equipment meant to be worn by a wearer. The term "panel of material," as used herein, may mean a unitary panel of material without seams (i.e., seamless) or it may mean multiple pieces of material affixed together to form a structure. As used in this disclosure, terms such as "affixing, " "coupling," "securing," and the like may mean releasably attaching or permanently attaching two or more elements together. Elements may be releasably attached using, for instance, zippers, sliders, button, hooks, snaps, hook-and-loop fasteners, releasable adhesives, and the like. Elements may be permanently attached using, for instance, stitching, bonding, welding, laminates, adhesives, and the like.

Turning now to FIG. 1, a front view of an apparel item 100 having an exemplary pocket system is shown in accordance with aspects herein. The apparel item 100 is shown in the form of a pair of shorts, but it is contemplated herein that the apparel item 100 may be any type of apparel item for a lower torso of a wearer such as pants, capris, tights, and the like. The apparel item 100 is formed from at least a first panel of material 110 that forms an outer layer of the apparel item 100, and a second panel of material 116 (shown by dashed lines to indicate it is hidden from view) that forms an inner layer of the apparel item 100. In some aspects, the first panel of material 110 may comprise a separate panel from the second panel of material 116, and in other aspects, the first and second panels of material 110 and 116 may comprise a single piece of material that is manipulated to form the different layers of the apparel item 100. Any and all aspects, and any variation thereof, are contemplated as being within aspects herein.

In exemplary aspects, the first panel of material 110 may comprise a shell layer configured to protect the wearer from the elements. For instance, the first panel of material 110 may comprise a light-weight material that is wind-resistant (e.g., a tightly woven or knit material), water-resistant (e.g., a material treated with a durable water repellant (DWR)), and/or a material that dries quickly. In exemplary aspects, the second panel of material 116 may comprise a liner layer. As such, the second panel of material 116 may comprise an elastically resilient material that exhibits properties such as moisture wicking, odor control, a soft hand, and the like. Although the second panel of material 116 is shown in the form of a short having distinct leg portions, it is contemplated herein that the second panel of material 116 may be in the form of a bikini-type brief, a compression layer, and the like. The first panel of material 110 and the second panel of material 116 may individually and/or collectively define leg portions 112 and 114 of the apparel item 100, and leg openings 124 and 126 of the apparel item 100. The apparel item 100 may further comprise a double-layer waistband 118 that helps to define a waist opening 122 of the apparel item 100.

Continuing, in exemplary aspects, the apparel item 100 comprises a pocket structure 130 (shown by dashed lines to indicate it is hidden from view). A pocket opening 120 that is in communication with the pocket structure 130 is positioned on the waistband 118. The pocket opening 120, in some exemplary aspects, may be configured as a slit-type opening to minimize the profile of the opening 120 and to help secure objects stowed in the pocket structure 130. The location and the size of the opening 120 and the pocket structure 130 are exemplary only. For example, the apparel item 100 may include other pocket openings and pocket structures that vary in location from that shown in FIG. 1 (see, for example, FIG. 2). Moreover, the size of the pocket opening 120 and/or the size of the pocket structure 130 may be adjusted to accommodate different sizes of objects meant to be stowed within the pocket structure 130. For instance, the opening 120 and the pocket structure 130 may be larger when the pocket structure is configured to hold a cell phone, and the opening 120 and the pocket structure 130 may be smaller when the pocket structure is configured to hold a smaller object such as a house key. Any and all aspects, and any variation thereof, are contemplated as being within aspects herein.

The apparel item 100 may optionally include other features such as a draw cord 128 that is useable for tensioning the waistband 118. As described more fully below, the draw cord 128 may be positioned between inner and outer layers of the double-layer waistband 118 and ends of the draw cord 128 may exit the waistband 118 via apertures or openings as shown.

Figure 2:
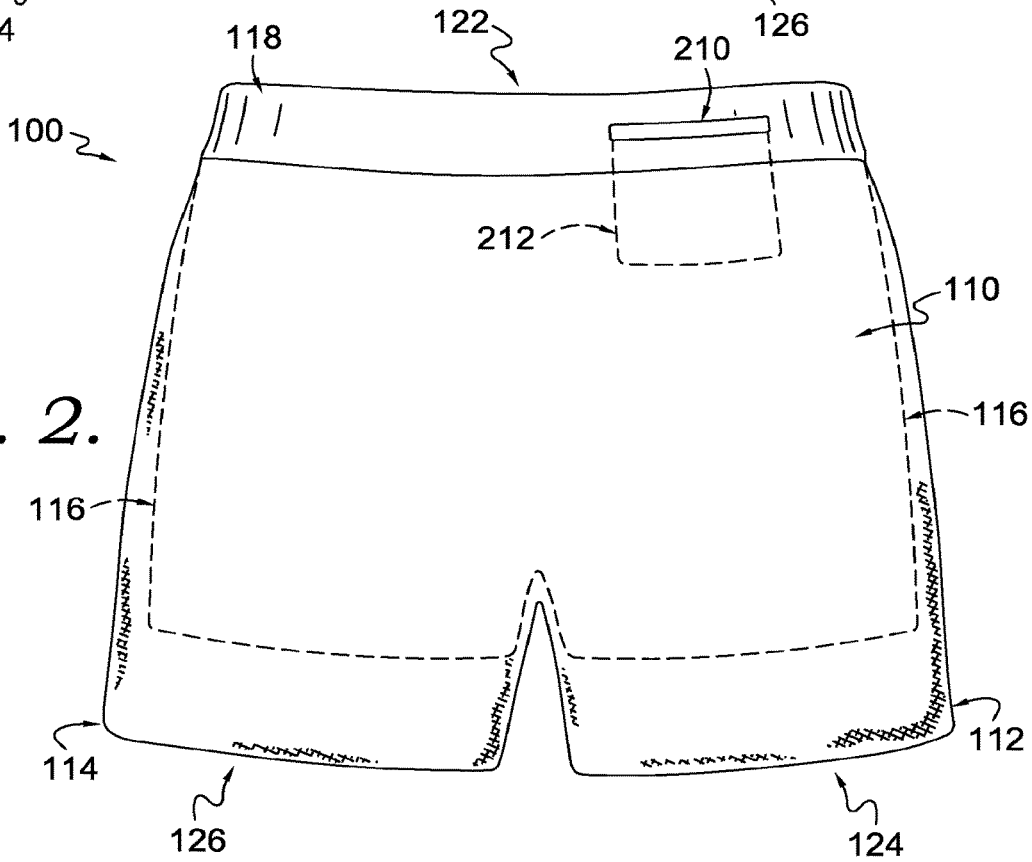
FIG. 2 illustrates a back view of the apparel item of FIG. 1 in accordance with aspects herein.

FIG. 2 illustrates a back view of the apparel item 100 in accordance with aspects herein. A second pocket opening 210 is depicted on the back of the apparel item 100 at the waistband 118, where the pocket opening 210 is in communication with a second pocket structure 212. As stated, it is contemplated herein that the apparel item 100 may comprise multiple pocket openings and multiple pocket structures. Any and all aspects, and any variation thereof, are contemplated as being within aspects herein.

Figure 3:
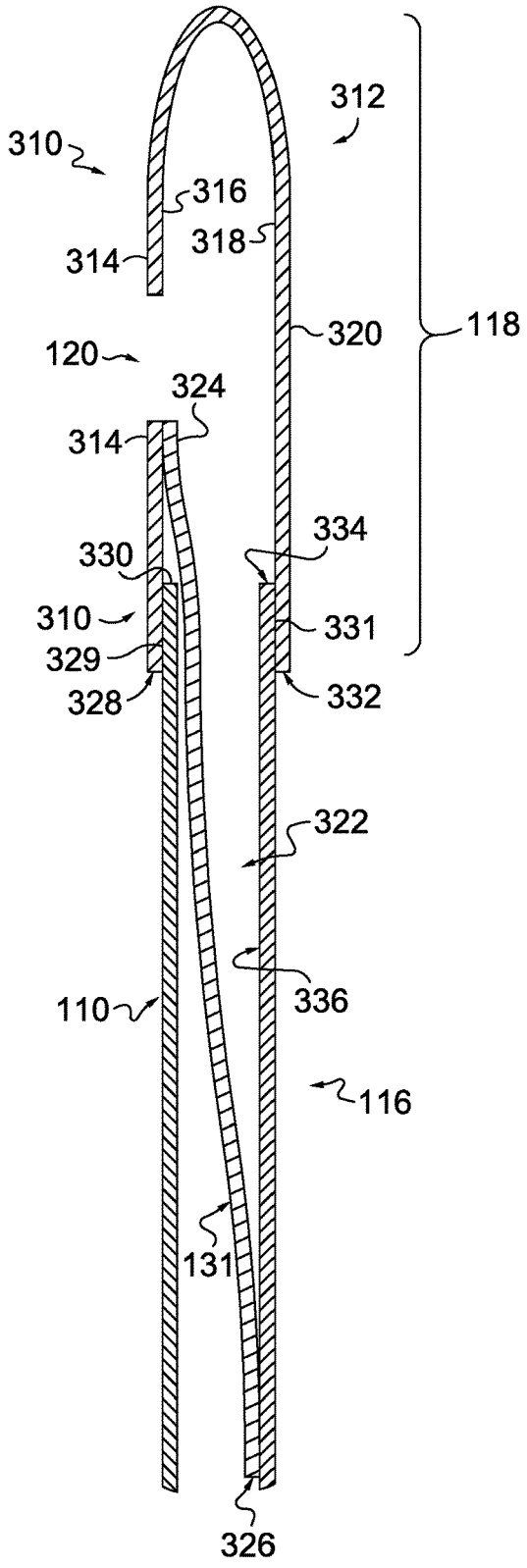
FIG. 3 illustrates a cross-sectional view of the exemplary pocket system of FIG. 1 taken along cut line 3-3 of FIG. 1 in accordance with aspects herein.

Turning now to FIG. 3, FIG. 3 illustrates a cross-sectional view of the pocket structure 130 taken along cut line 3-3 of FIG. 1 in accordance with aspects herein. As shown in FIG. 3, the waistband 118 comprises a double-layered arrangement having an outer layer 310 and an inner layer 312. In aspects, the waistband 118 may be formed by folding a single layer of material onto itself to form the double-layer waistband 118 (shown in FIG. 3). It is also contemplated herein, that the waistband 118 may comprise two separate layers that are joined together at the top of the waistband 118 by stitching, bonding, or other affixing means.

The outer layer 310 of the waistband 118 may have a first surface 314 and a second surface 316 opposite the first surface 314. Similarly, the inner layer 312 of the waistband 118 may comprise a third surface 318 and a fourth surface 320 opposite the third surface 318. The second surface 316 of the outer layer 310 of the waistband 118 is positioned adjacent to the third surface 318 of the inner layer 312 of the waistband 118 to define a space between the layers 310 and 312. The pocket opening 120 extends through the outer layer 310 of the waistband 118. The pocket opening 120 may be formed through mechanical cutting, laser cutting, manipulating a knitting or weaving process to form the opening 120, and the like.

Continuing, in exemplary aspects, a top edge 330 of the first layer of material 110 of the apparel item 100 may be affixed to a bottom margin 328 of the outer layer 310 of the waistband 118 at a first seam line 329. More particularly, the top edge 330 of the first layer of material 110 may be affixed to the second surface 316 of the outer layer 310 of the waistband 118 adjacent the bottom margin 328 of the outer layer 310 at the first seam line 329. In aspects, the location where the top edge 330 of the first layer of material 110 is affixed to the outer layer 310 of the waistband 118 may be inferior to the pocket opening 120. As well, a top edge 334 of the second layer of material 116 may be affixed to a bottom margin 332 of the inner layer 312 of the waistband 118 at a second seam line 331. More particularly, the top edge 334 of the second layer of material 116 may be affixed to the third surface 318 of the inner layer 312 of the waistband 118 adjacent the bottom margin 332 of the inner layer 312 at the second seam line 331.

A pocket panel 131 used to form the pocket structure 130 is positioned in a space between the first layer of material 110 and the second layer of material 116. In exemplary aspects, the pocket panel 131 may be formed of an elastically resilient material. Use of an elastically resilient material may help to more securely stow objects within the pocket structure 130 by helping to minimize their movement once stowed. Further, the pocket panel 131 may be formed of a mesh material. Use of a mesh material may contribute to the overall breathability of the pocket structure 130. Moreover, mesh materials tend to be more lightweight as compared to traditional fabrics, thus contributing to the overall light-weight of the apparel item 100.

As illustrated in FIG. 3, a top edge 324 of the pocket panel 131 is affixed to the second surface 316 of the outer layer 310 of the waistband 118 at a location inferior and adjacent to the pocket opening 120 (as used throughout this disclosure the term "adjacent" may mean within about 0 mm to 5.0 cm of a designated reference point). In exemplary aspects, the location at which the top edge 324 of the pocket panel 131 is affixed to the outer layer 310 of the waistband 118 is superior to the location at which the top edge 330 of the first layer of material 110 is affixed to the outer layer 310 of the waistband 118. A bottom edge 326 of the pocket panel 131 is affixed to an inner-facing surface 336 of the second layer of material 116 at a location inferior to where the top edge 324 of the pocket panel 131 is affixed to the outer layer 310 of the waistband 118. Depending on a desired size of the pocket structure 130, the bottom edge 326 of the pocket panel 131 may be affixed to the second layer of material 116 from 2 cm up to 15 cm inferior to the top edge 334 of the second panel of material 116.

Figure 5:
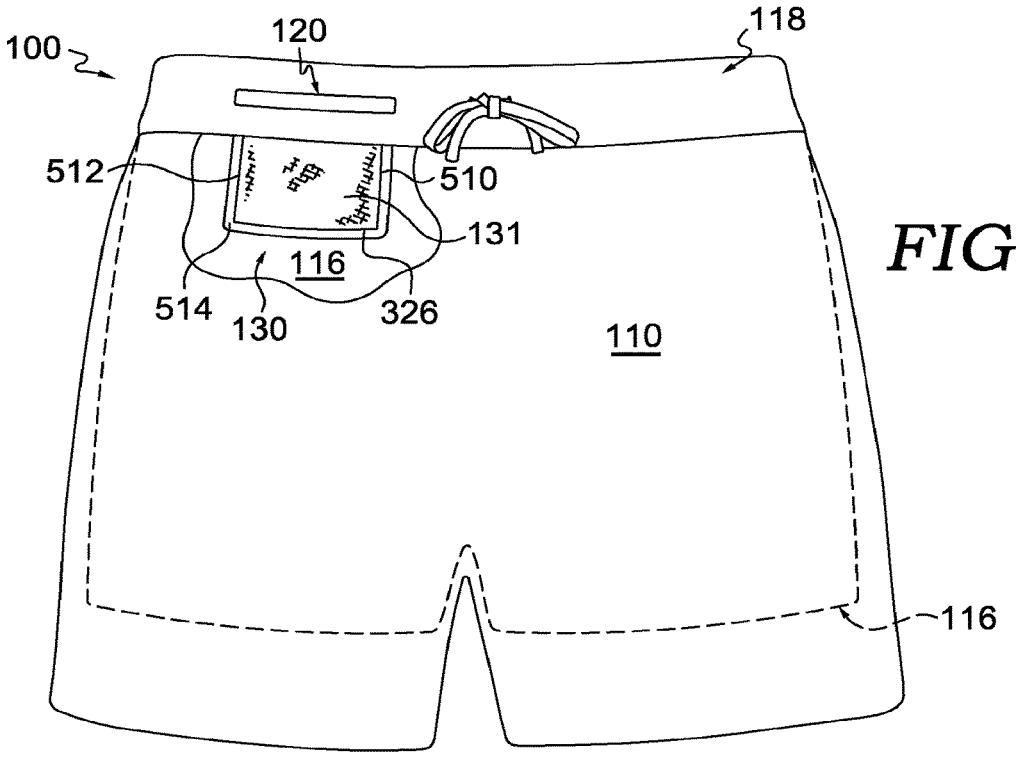
FIG. 5 illustrates a cut-away view of the apparel item of FIG. 1 in accordance with aspects herein.

By affixing the pocket panel 131 as described, a pocket space 322 is formed between the pocket panel 131 and the second layer of material 116, where the pocket space 322 is useable for stowing objects. It is contemplated herein that the pocket panel 131 comprises one or more additional edges, and these additional edges may also be affixed to the second layer of material 116 to more securely seat the pocket and prevent its movement during wearer activities. This aspect is shown in FIG. 5, which illustrates a front view of the apparel item 100 with a portion of the first layer of material 110 cut away to show the pocket structure 130. The pocket panel 131 comprises one or more additional edges such as opposing side edges 510 and 512. The side edges 510 and 512 as well as the bottom edge 326 of the pocket panel 131 may be affixed to the second layer of material 116 by stitching, use of an adhesive, a polyurethane tape, an adhesive tape, and the like. This is indicated by reference numeral 514 in FIG. 5. Although the pocket panel 131 is shown in a generally square shape, it is contemplated herein that is may assume other shapes such as rectangular, triangular, circular, and the like. Any and all aspects, and any variation thereof, are contemplated as being within aspects herein.

Figure 4:
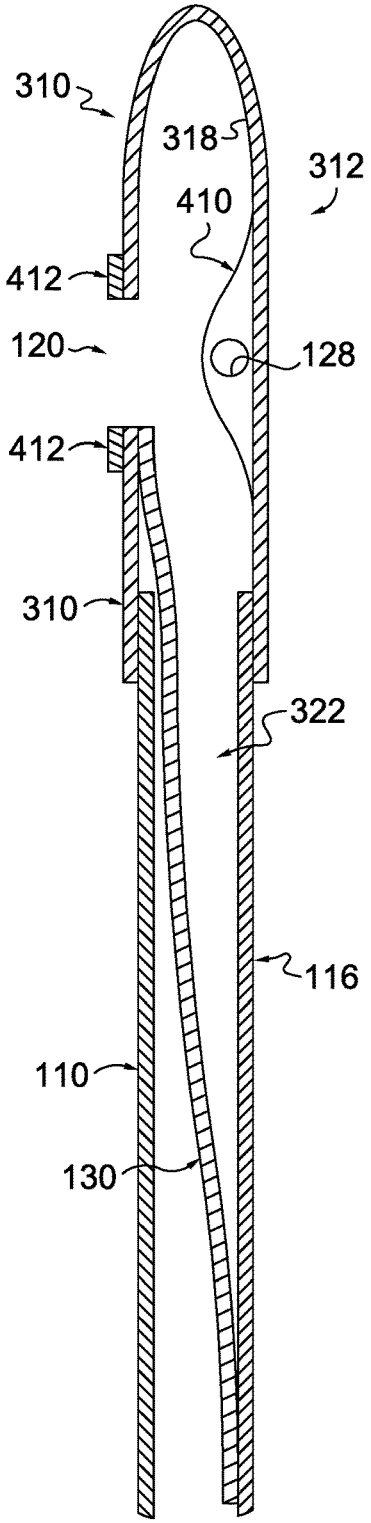
FIG. 4 illustrates a cross-sectional view of an alternative configuration of the exemplary pocket system in accordance with aspects herein.

FIG. 4 illustrates a cross-sectional view of the pocket structure 130 with some additional optional elements shown in accordance with aspects herein. As described above, an optional draw cord 128 may be utilized on the apparel item 100 to tension the waistband 118, where the draw cord 128 is positioned in the space between the outer layer 310 of the waistband 118 and the inner layer 312 of the waistband 118. To prevent the draw cord 128 from inadvertently exiting the waistband 118 at the pocket opening 120 or the pocket opening 210, the draw cord 128 may be moveably maintained against the third surface 318 of the inner layer 312 of the waistband 118. For instance, a material 410, such as a mesh fabric, may be positioned over or adjacent to the draw cord 128 and secured to the third surface 318 of the inner layer 312 of the waistband 118, thereby forming a tunnel structure that encloses the draw cord 128 in the space between the material 410 and the third surface 318 of the inner layer 312 while still enabling the draw cord 128 to move longitudinally in the space. Other ways of moveably maintaining the draw cord 128 against the inner layer 312 of the waistband 118 are contemplated herein such as spaced-apart tack stitches, spaced-apart loops, and the like. Any and all aspects, and any variation thereof, are contemplated as being within aspects herein.

FIG. 4 illustrates another optional element comprising a reinforcement material 412 positioned around the edges of the pocket opening 120. The reinforcement material 412 may extend the length of the pocket opening 120 and help secure the edges of the opening 120 to prevent fraying, tearing, and the like. The reinforcement material 412 may comprise an adhesive tape, a bonded tape, a polyurethane film, a silicone film, and the like. Moreover, the reinforcement material 412 may have elastic or stretch characteristics so as to stretch when objects are being inserted through the pocket opening 120 and positioned within the pocket space 322.

Figure 6:
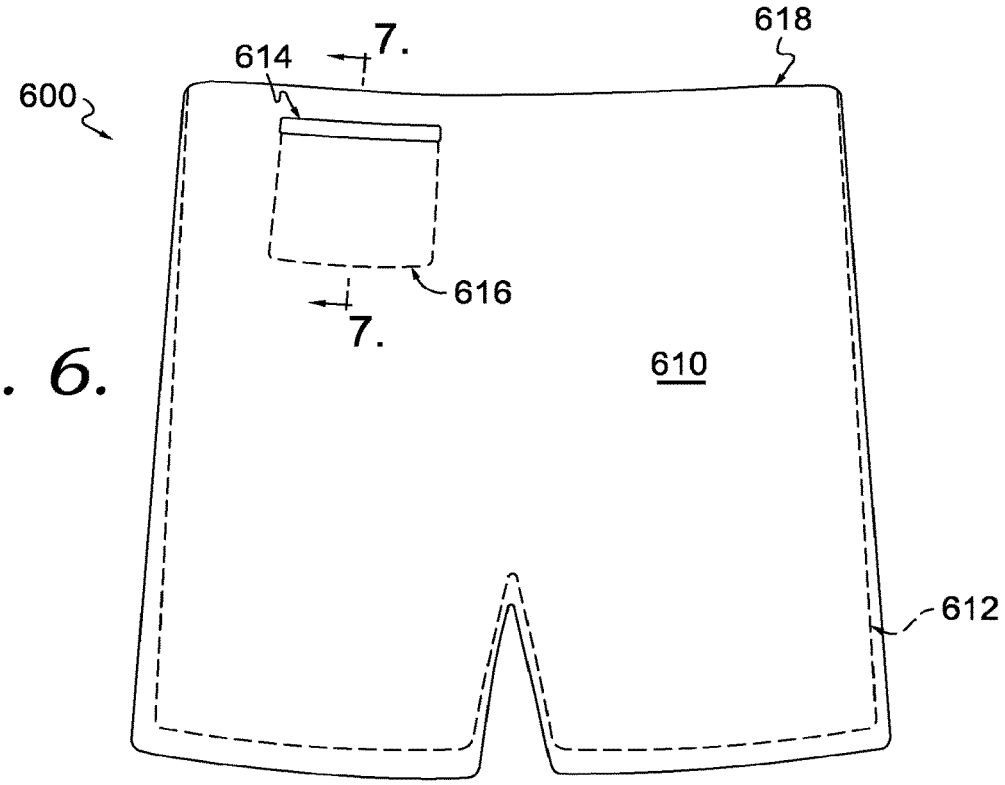
FIG. 6 illustrates an exemplary apparel item having an alternative exemplary pocket structure in accordance with aspects herein.

FIG. 6 illustrates an alternative construction for an apparel item 600 for a lower torso of a wearer in accordance with aspects herein. Similar to the apparel item 100, the apparel item 600 comprises a first panel of material 610 (an outer layer of the apparel item 600) and a second panel of material 612 positioned interior to the first panel of material 610. However, instead of having a separate waistband element, such as the waistband 118 of the apparel item 100, the top edges of the first and second panels of material 610 and 612 may comprise the upper or top edge 618 of the apparel item 600. Thus, instead of a pocket opening being formed through the waistband, a pocket opening 614 may be formed through the first layer of material 610, where the pocket opening 614 communicates with a pocket structure 616.

Figure 7:
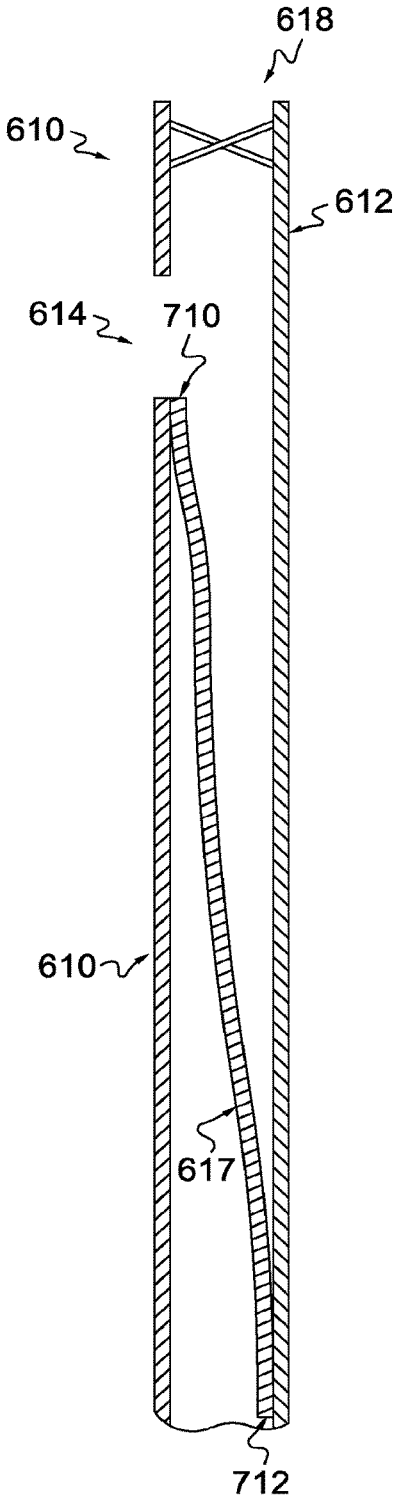
FIG. 7 illustrates a cross-sectional view of the alternative exemplary pocket structure of FIG. 6 taken along cut line 7-7 of FIG. 6 in accordance with aspects herein.

A cross-sectional view of this construction is shown in FIG. 7, where the cross-sectional view is taken along cut line 7-7 of FIG. 6. As shown in FIG. 7, the first panel of material 610 may be affixed to the second panel of material 612 at the top edge 618 via, for instance, stitching. It is also contemplated herein, that the first panel of material 610 and the second panel of material 612 may comprise a single piece of material that is folded over onto itself to form the top edge 618. Any and all aspects, and any variation thereof, are contemplated as being within aspects herein. The pocket structure 616 is formed by positioning a pocket panel 617 between the first panel of material 610 and the second panel of material 612 and affixing a top edge 710 of the pocket panel 617 to an inner surface of the first panel of material 610 at a location adjacent and inferior to the pocket opening 614. The bottom edge 712 of the pocket panel 617 may be affixed to an inner surface of the second panel of material 612 at a location inferior to where the top edge 710 is affixed to the first panel of material 610. Similar to the construction shown in FIG. 5, additional edges of the pocket panel 617 may be affixed to the second panel of material 612 to more securely seat the pocket structure 616.

Figure 8:
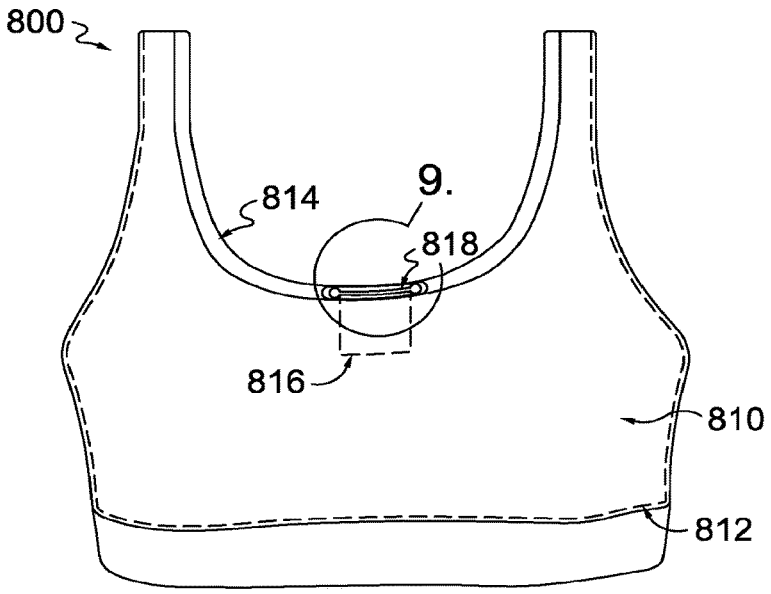
FIG. 8 illustrates an example of a different apparel item having an exemplary pocket structure in accordance with aspects herein.

It is contemplated that the pocket structure described herein may be used on other types of apparel items. For example, the pocket structure may be used on an apparel item for an upper torso of a wearer. Such an exemplary apparel item is shown in FIG. 8 which illustrates an apparel item 800 in the form of a support garment such as a bra. The apparel item 800 comprises a first layer of material 810 and a second layer of material 812 (shown by the dashed lines) positioned adjacent and interior to the first layer of material 810. A double-layered trim piece 814 is positioned along a top edge of the apparel item 800. Similar to the construction of the pocket structure 130 of the apparel item 100, a pocket panel 816 is positioned in the space between the first layer of material 810 and the second layer of material 812, and a top edge of the pocket panel 816 is affixed to an inner surface of the outer layer of the trim piece 814, and at least a bottom edge of the pocket panel 816 is affixed to an inner surface of the second layer of material 812 to define a pocket space between the pocket panel 816 and the second layer of material 812. An opening 818 formed in the outer layer of the trim piece 814 is in communication with the pocket space.

Figure 9:
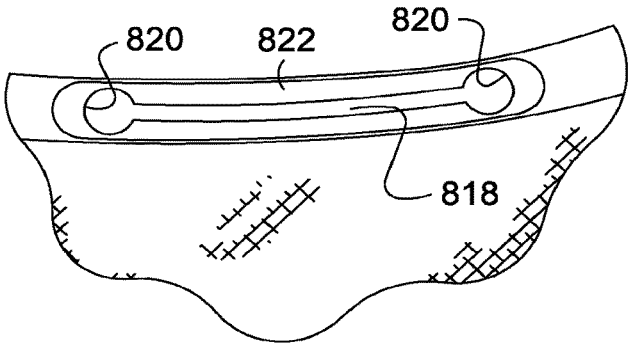
FIG. 9 illustrates an enlarged view of a pocket opening of the exemplary pocket structure of FIG. 8 in accordance with aspects herein.

An enlarged view of the opening 818 is also shown in FIG. 9. In exemplary aspects, the opening 818 is generally linear but may have circular-type openings 820 at each end of the opening 818 to, for example, reduce tearing when objects are inserted within the opening 818. The enlarged view of FIG. 9 also shows a reinforcement material 822 surrounding the opening 818 to further reinforce the opening 818 and prevent tearing or fraying.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An apparel item for a lower torso of a wearer, the apparel item comprising:

an outer panel of material;

an inner panel of material, wherein the outer panel of material and the inner panel of material form at least a torso portion of the apparel item;

a waistband comprising a first layer and a second layer, wherein at least one opening is formed in the first layer of the waistband, and wherein a top edge of the outer panel of material is affixed to the first layer of the waistband at a first seam line and a top edge of the inner panel of material is affixed to the second layer of the waistband at a second seam line; and at pocket panel positioned between the outer panel of material and the inner panel of material, the pocket panel comprising at least a top edge, a bottom edge, and opposing side edges, wherein the top edge of the pocket panel is affixed to the first layer of the waistband, and the bottom edge of the pocket panel is affixed to the inner panel of material so as to define a space between the pocket panel and at least the inner panel of material, and wherein the at least one opening in the first layer of the waistband is in communication with the space between the pocket panel and the inner panel of material.

2. The apparel item of claim 1, wherein the first layer of the waistband comprises a first surface and a second surface opposite the first surface, wherein the second layer of the waistband comprises a third surface and a fourth surface opposite the third surface, and wherein the second surface of the first layer of the waistband is positioned adjacent to the third surface of the second layer of the waistband.

3. The apparel item of claim 2, wherein the top edge of the outer panel of material is affixed to the second surface of the first layer of the waistband at the first seam line, and wherein the top edge of the inner panel of material is affixed to the third surface of the second layer of the waistband at the second seam line.

4. The apparel item of claim 3, wherein the top edge of the pocket panel is affixed to the second surface of the first layer of the waistband.

5. The apparel item of claim 4, wherein the top edge of the pocket panel is affixed to the second surface of the first layer of the waistband at a location inferior and adjacent to the at least one opening in the first layer of the waistband.

6. The apparel item of claim 5, wherein the top edge of the outer panel of material is affixed to the first layer of the waistband at a location inferior to where the top edge of the pocket panel is affixed to the first layer of the waistband.

7. The apparel item of claim 1, wherein the opposing side edges of the pocket panel are affixed to the inner panel of material.

8. The apparel item of claim 1, wherein the pocket panel comprises an elastically resilient mesh material.

9. The apparel item of claim 1, wherein the apparel item comprises a short.

* * * * *